US005592696A

United States Patent [19]

Oliver

[11] Patent Number: 5,592,696

[45] Date of Patent: Jan. 14, 1997

[54] ORNAMENTAL HAT-BRIM SLIP COVER AND METHOD OF MANUFACTURE

[76] Inventor: Doreen A. Oliver, 1758 Malon Pl., Show Low, Ariz. 85901

[21] Appl. No.: 578,838

[22] Filed: Dec. 26, 1995

Related U.S. Application Data

[63] Continuation-in-part of Ser. No. 272,568, Jul. 11, 1994, abandoned.

[51] Int. Cl.[6] ..... A42B 1/02

[52] U.S. Cl. ..... 2/175.3; 2/175.6

[58] Field of Search ..... 2/175.6, 175.1, 2/175.3, 200.2, 183

[56] References Cited

U.S. PATENT DOCUMENTS

| | | | |
|---|---|---|---|
| 128,780 | 7/1872 | Battle | 2/175.6 |
| 238,865 | 3/1881 | Davis | 2/183 X |
| 1,214,128 | 1/1917 | Brooks | 2/175.6 |
| 1,368,864 | 2/1921 | Turner | 2/175.6 |
| 1,714,100 | 5/1929 | Moeller | 2/175.6 |
| 1,716,537 | 6/1929 | Acocella | 2/175.6 |
| 1,901,987 | 3/1933 | Roderick | 2/175.6 |
| 2,181,106 | 11/1939 | Timmons et al. | 2/175.6 |
| 2,424,414 | 7/1947 | Oppenheimer | 2/175.6 |

*Primary Examiner*—Peter Nerbun
*Attorney, Agent, or Firm*—Antonio R. Durando

[57] ABSTRACT

A slip cover for the brim of a hat that consists of two substantially-annular pieces of fabric having an outer edge conforming to the size of a hat brim and an inner edge at least as large as the crown of the hat. The outer edges are joined to form a slip cover suitable for placement over the brim of any conforming hat, thereby changing the appearance thereof according to the designs on the fabrics utilized. The slip cover may be turned inside out and used reversibly to display the other side of the fabric which may contain different designs to provide yet another look for the hat. Another embodiment of the invention consists of a slip cover having the lower inner edge made of stretchable material and smaller than the crown of the hat, thereby providing an inner elastic band for engaging the head of a wearer and improving retention of the hat. In a third embodiment of the invention, the upper inner edge is also made of stretchable material and smaller than the crown of the hat so as to provide an outer ornamental band.

11 Claims, 4 Drawing Sheets

ORNAMENTAL HAT-BRIM SLIP COVER AND METHOD OF MANUFACTURE

RELATED APPLICATIONS

This application is a continuation-in-part of Ser. No. 08/272,568, filed on Jul. 11, 1994, by the same inventor and now abandoned.

BACKGROUND OF THE INVENTION

1. Field of the Invention

This invention is related in general to covers for hats. In particular, it describes a removable slip-cover for a hat brim that enables a user to adapt the appearance of the hat to changed circumstances while also enhancing the fit and stability of the hat on a user.

2. Description of the Related Art

Articles of apparel such as hats are normally selected by wearers on the basis of appearance, utility and comfort, with much emphasis being put on the aesthetic value of the fabric and the structural design of each article. When a user particularly likes the shape of an item such as a hat, he or she might purchase more than one in different colors and fabric designs. This practice can be expensive and is obviously not efficient in view of the fact that only one article at a time can be worn. Therefore, it would be desirable to be able to change the appearance of an article to produce a different look in the same structural configuration, thus effectively providing the same utility as that of a separate article.

The appearance of a hat may be changed substantially by varying the pictorial design of its brim, which could be achieved by providing removable replacement brims or covers for the permanent brim of a conventional hat. This latter approach is at the basis of the method and apparatus of this invention.

Different covers exist that can be used to protect hats of various shapes, but none are suitable for changing the appearance of the hat while substantially retaining its shape. This invention provides a simple method of achieving this result with a solution of universal application.

BRIEF SUMMARY OF THE INVENTION

The primary objective of this invention is a method of converting a brimmed hat into an article having the same shape but a different appearance by virtue of a distinct cover applied over the brim of the hat.

Another goal of the invention is a slip cover suitable for changing the appearance of the brim of a hat, thereby increasing the hat's usefulness to approach that of multiple hats with the same shape but varied designs.

Still another goal of the invention is a slip cover that is reversible and therefore suitable for providing two alternative and distinct looks to the hat to which it is applied.

Another objective is a slip cover that combines the aesthetic value of a new design with the functional value of added support to enhance the fit and stability of the hat on a wearer.

A final objective is a method of manufacture for such a slip cover that accomplishes the above mentioned goals in an economical and commercially viable manner. This is done by utilizing simple components that are either already available commercially or that can be produced at competitive prices.

Therefore, according to these and other objectives, the present invention consists of two substantially-annular pieces of fabric having an outer edge conforming to the shape and size of a hat brim and an inner edge at least as large as the crown of the hat. The outer edges are joined to form a slip cover suitable for placement over the brim of any conforming hat, thereby changing the appearance thereof according to the designs on the fabrics utilized. The slip cover may be turned inside out and used reversibly to display the other side of the fabric which may contain different designs to provide yet another look for the hat. Another embodiment of the invention consists of a slip cover having the lower inner edge made of stretchable material and smaller than the crown of the hat, thereby providing an inner elastic band for engaging the head of a wearer and improving retention of the hat. In a third embodiment of the invention, the upper inner edge is also made of stretchable material and smaller than the crown of the hat so as to provide an outer ornamental band.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose but some of the various ways in which the invention may be practiced.

DESCRIPTION OF THE PREFERRED EMBODIMENTS OF THE INVENTION

The present invention consists of a slip cover designed to fit snugly over the brim of a hat to provide a way to quickly change the appearance of such hat. The idea is conceived as a practical and inexpensive way to increase the utilization of each hat in the possession of a wearer. In addition, the slip cover of the invention can be utilized to improve the functional fit of the hat and increase its stability on the head of the user.

Figure 1:
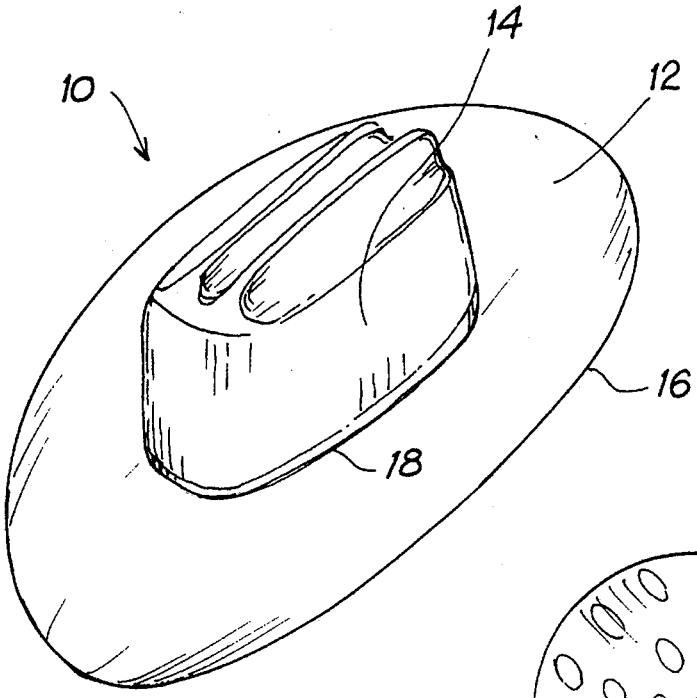
FIG. 1 is a perspective view of a conventional cowboy hat, shown as an example of a typical brimmed hat.

Referring to the drawings, wherein like parts are designated throughout with like numerals and symbols, FIG. 1 illustrates in perspective view a conventional brimmed hat 10. A typical cowboy hat is used for illustration, but any other style of hat comprising a substantially rigid, annular brim 12 around an approximately-tubular central crown 14 could be used as well. The hat 10 is shown, for example, as having uniform color throughout its outer surface. As detailed below, this invention is directed in part at changing the appearance of a hat such as the cowboy hat 10 by covering the brim 10 with a flexible, two-sided, substantially annular slip cover made with one or more fabrics having one or more patterns, designs or colors that may be different from the hat's own pattern, design or color.

As illustrated in FIGS. 2–5, the slip cover 20 of the invention comprises a first, top piece 22(seen in top view in FIG. 2) of preferably-elastic fabric or other equivalent flexible material sized to fit over the brim 12 of the hat for which it is intended. Accordingly, such piece of fabric has a substantially annular shape corresponding to the brim 12 of such hat. An outer edge 24 of the piece 22 of fabric is approximately equal in size and shape to the outer edge 16 of the brim of the hat 10, while an inner edge 26 is equal in size and shape to the perimeter 18 of the hat's crown 14 (which is also the inner edge of the brim 12); thus, the width of the piece 22 is substantially equal to the width of the brim 12.

Figure 3:
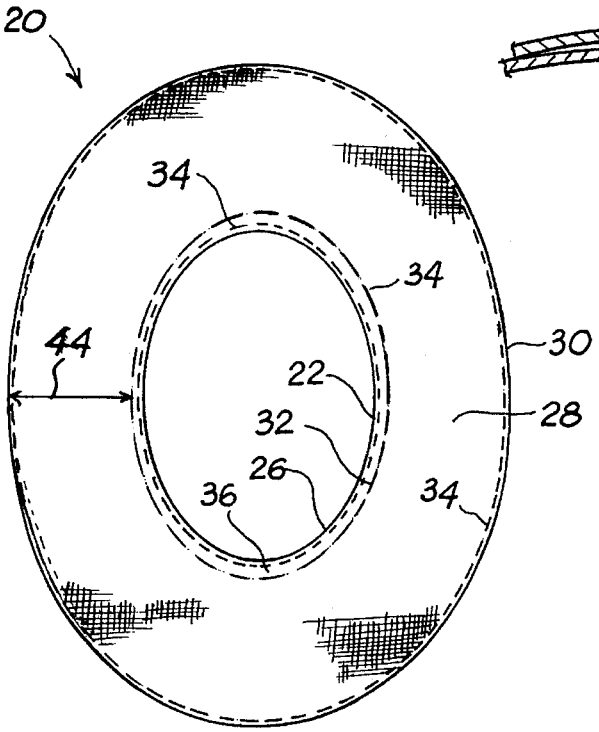
FIG. 3 is a bottom plan view of the slip cover of FIG. 2 as seen while resting on a flat surface.

The slip cover 20 also comprises a second, bottom piece 28 of similar fabric or other equivalent material sized to substantially match the first piece 22, as illustrated in the bottom plan view of FIG. 3. The second piece 28 of fabric is also sized so that its outer edge 30 is approximately equal to the brims's outer edge 16, and so that its inner edge 32 is at least equal in size to the perimeter 18 of the hat's crown 14 (that is, at least as large as the inner edge of the brim 12). The two pieces 22 and 28 are superimposed and joined at their outer edges 24 and 30, such as by stitches 34, to form an approximately annular structure with an inner boundary 36 that can be opened to insert a conforming, substantially-flat structure, such as a brim, between the two pieces of fabric 22 and 28. Note that at least one of the two pieces 22 and 28 must be made of material that can be stretched to fit around the brim of a hat.

Figure 4:
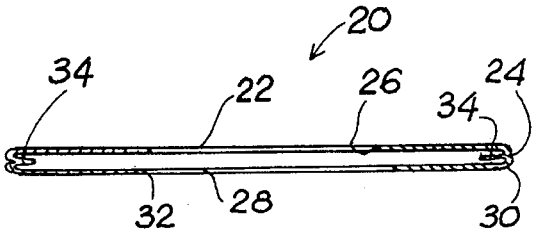
FIG. 4 is a cross-sectional view of the slip cover of FIG. 2 as seen from line 4—4 in that figure.
Figure 5:
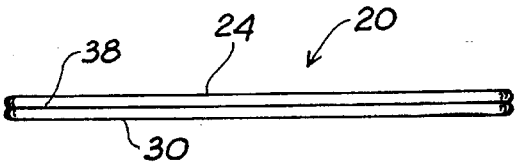
FIG. 5 is a side view of the slip cover of FIG. 2 as seen from line 5—5 in that figure.

FIG. 4 shows in cross-sectional view the way the two pieces of fabric 22 and 28 are joined by stitches 34, or other equivalent means, along their outer edges 24 and 30 to form the slip cover 20 of the invention. FIG. 5 illustrates in side view the common outer edge 38 formed by joining the outer edges 24 and 30 of each separate piece of fabric.

Figure 7:
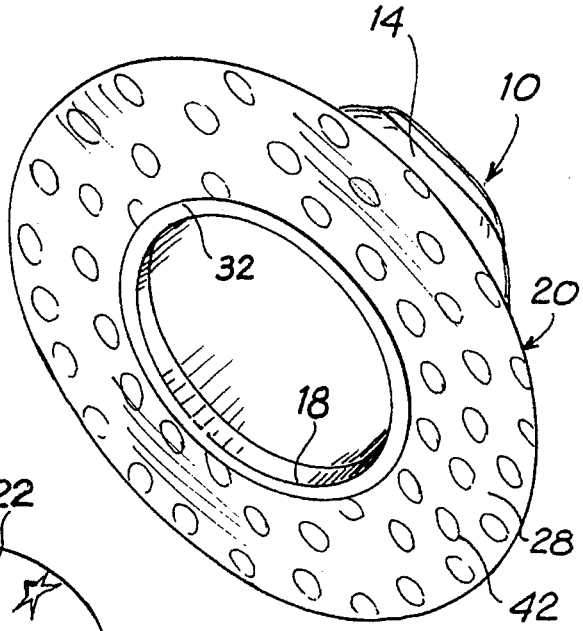
FIG. 7 is another illustration of the ornamental slip cover according to FIG. 2 after placement over the brim of the hat of FIG. 1.
Figure 6:
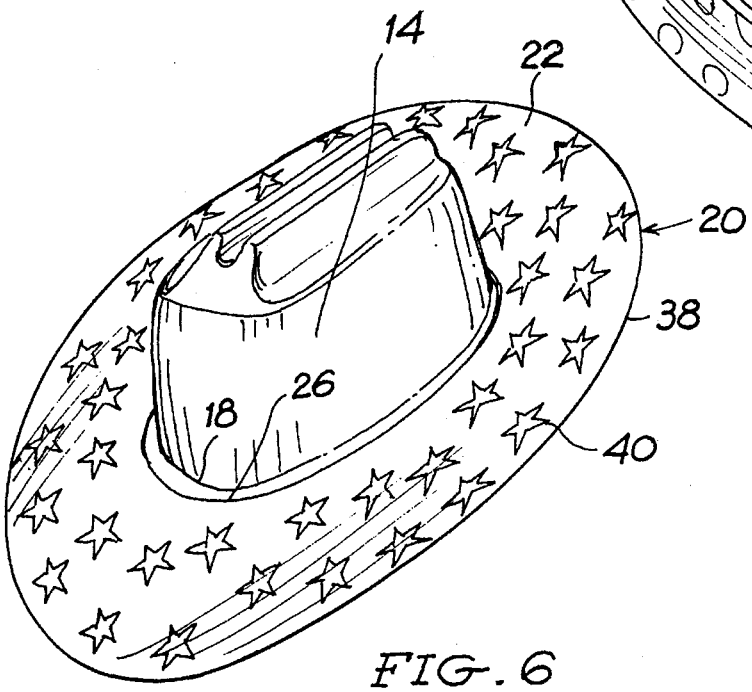
FIG. 6 is a perspective illustration of a slip cover of FIG. 2 after placement over the brim of the hat of FIG. 1.

Thus, because of the stretchable nature of fabrics (or at least one of them), the slip cover 20 can be slipped over the rim 12 of the hat 10 to form a snugly-fitting cover that does not materially alter the shape of the hat. If, on the other hand, the material or materials of the slip cover 20 contain patterns or designs distinctly different from those in the brim 12 of the hat, the slip cover 20 may be used to cover the brim and display the designs in its fabric, thus presenting a distinctly different appearance to a viewer. FIG. 6 shows, by way of illustration, a slip cover having a star-spangled pattern 40 as seen after placement on the brim 12 of the hat 10. Similarly, FIG. 7 illustrates a dotted pattern 42 on the bottom side of a slip cover 20 according to the invention seen from the underside of the brim of the hat 10.

Note that the two pieces of fabric 22 and 28 are illustrated in the drawings with reference to a top (piece 22) and a bottom (piece 28), but these references are for example only. Obviously, they could be reversed with the same functionality to provide yet another look for the hat on which the slip cover of the invention is being used. The perimeter of the inner edge 32 of the bottom piece 28 of fabric may be substantially larger than the perimeter of the hat's crown 14, so long as the width 44 (see FIG. 3) of the fabric is sufficient to provide a retaining lip over the edge 16 of the hat's brim to keep the slip cover in place during use. Similarly, note that any embodiment of the invention can be flipped inside out and used in the same manner to cover the brim of a hat, thereby providing the possibility of displaying yet another design or pattern placed thereon.

Figure 8:
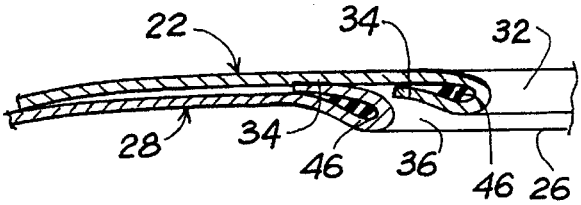
FIG. 8 is an enlarged, partial cross-sectional view of an embodiment of the invention of FIG. 2 including elastic bands along its inner edges.

The slip cover 20 of the invention may be easily manufactured by cutting two pieces (22 and 28) of fabric or equivalent material in such a size that, when flat, they match substantially the outer and inner edges of the brim 12 of a hat 10 for which the cover is intended. The outer edges 24 and 30 of the two pieces of fabric are then attached, preferably by sewing, and their inner edges 26 and 32 are hemmed to avoid fraying, if necessary. As illustrated in the enlarged, partial cross-sectional view of FIG. 8, depending on the fabric's (or other material's) own elasticity, it may also be desirable or necessary to include an elastic string 46 within each hemmed portion along the perimeter of the inner edges 26 and 32 of the slip cover. Such elastic band will improve the fit of the slip cover over the brim of the hat by ensuring that the fabric remains taught and unwrinkled during use.

Figure 9:
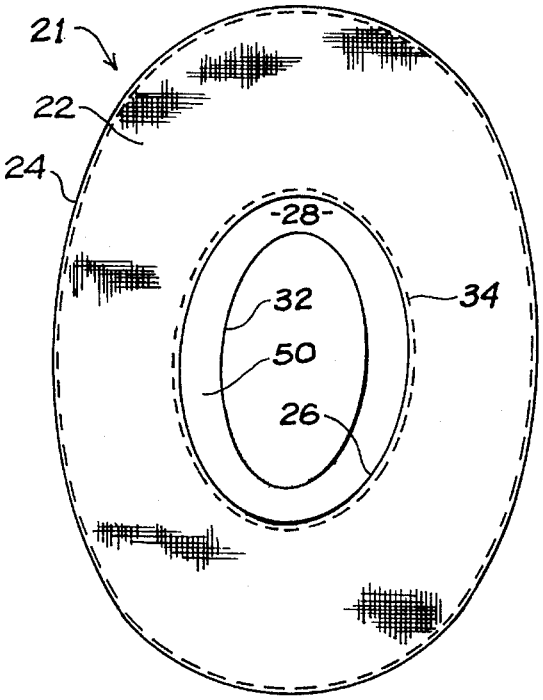
FIG. 9 is a top plan view of another embodiment of the slip cover according to the invention having a bottom member with an inner portion extending inward from the perimeter of the hat's crown.
Figure 10:
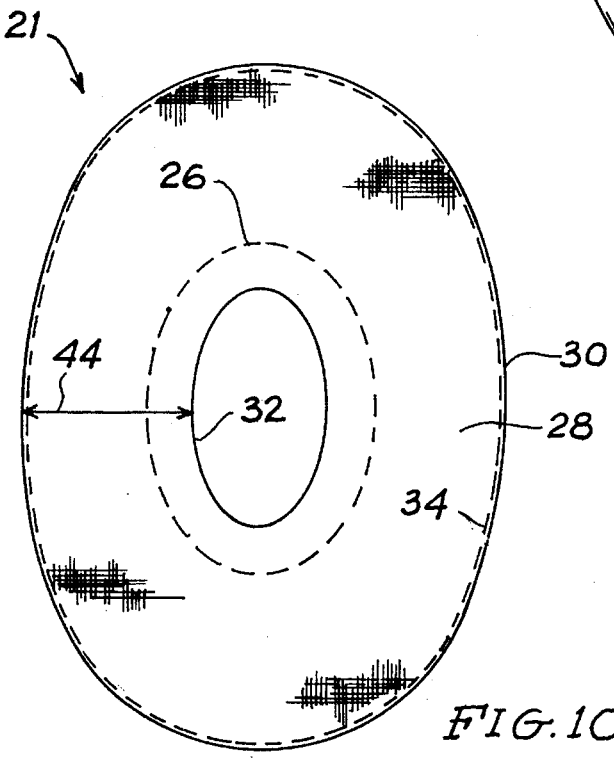
FIG. 10 is a bottom plan view of the slip cover of FIG. 9.

In a different embodiment of the invention, the aesthetic function of the slip cover is combined with a structural function by making the inner edge 32 of the bottom piece 28 substantially smaller than the size of the crown 14 and by selecting stretchable material for that piece. This may easily be achieved by extending the width 44 of the bottom piece 28 by cutting a smaller opening than the crown's circumference, such as a round or oval opening about half the size of the crown, as illustrated in top and bottom views of the slip cover 21 in FIGS. 9 and 10, respectively. This configuration provides an inner portion 50 in the form of a band that extends inward from the inner edge of the brim (that is, from the perimeter 18 of the crown 14) and folds inward and engages the head of a user when the hat is worn, thereby providing added support and stability. Upon leaning forward, or otherwise subjected to a gust or wind or other force that might normally displace the hat, a user will benefit from the elastic engagement of the inner band 50 to the user's head, which will prevent the displacement of the hat under normal conditions. The inner portion 50 is preferably the size of a normal sweat band; that is, about 1.5–2.0 inches wide.

Figure 11:
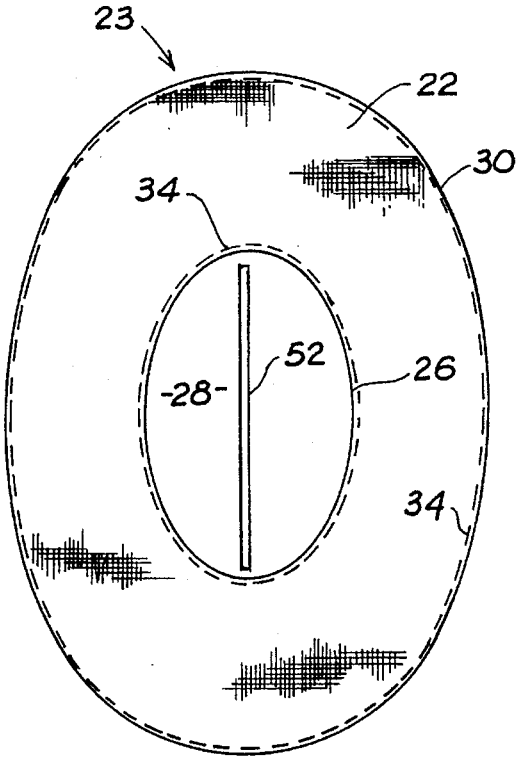
FIG. 11 is a top plan view of yet another embodiment of the slip cover according to the invention having a bottom member with an inner portion extending inward from the perimeter of the hat's crown formed by cutting a slit in the middle of the material constituting the bottom member.
Figure 12:
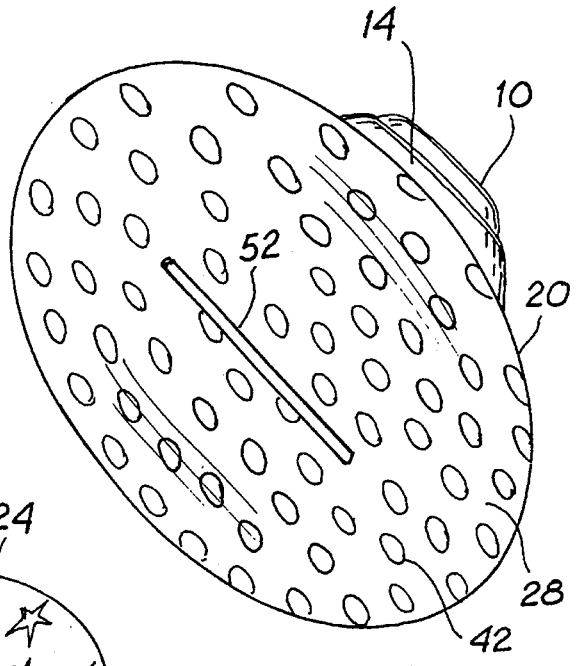
FIG. 12 is a perspective illustration of a slip cover of FIG. 11 after placement over the brim of the hat of FIG. 1.

In an alternate embodiment 23, I found that even a simple linear slit 52 along the middle of the bottom piece 28, such as shown in the top view of FIG. 11 and the perspective view of FIG. 12, combined with an easily stretchable material such as the polyurethane multifilament elastomer sold by the DuPont Company under the registered trademark Lycra ®, provides an inner portion 50 that suitably folds inward and engages the head for better retention and fit when a user wears the hat By using Lycra ®as the preferred material of manufacture, which does not frey even if not hemmed, the process of manufacture is greately simplified. Therefore, this embodiment is preferred. Preferably, the length of the slit 52 is about the same as or slightly less than the diameter of the crown 14.

Figure 13:
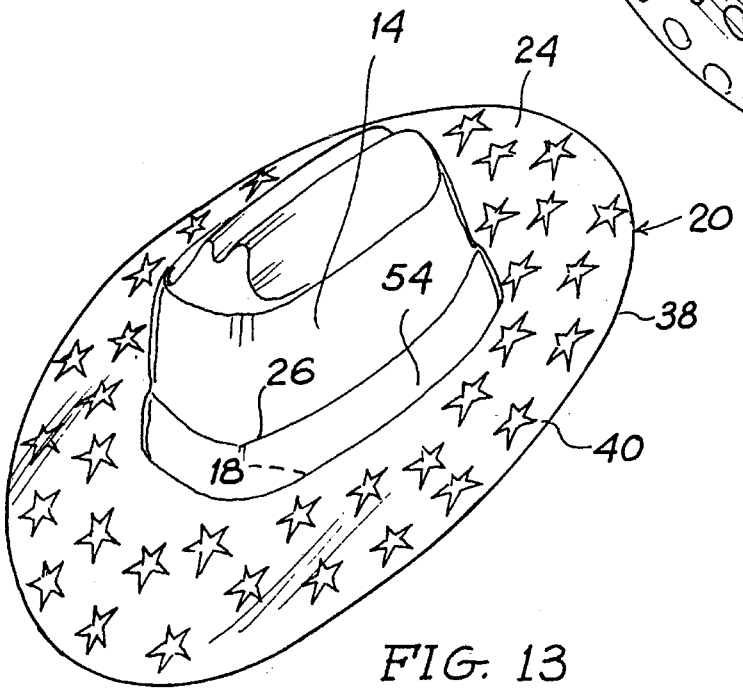
FIG. 13 is a top plan view of still another embodiment of the slip cover according to the invention having a top member with an inner portion extending inward from the perimeter of the hat's crown to form an ornamental band around the crown of the hat.

Any of these embodiments can be further modified by also reducing the size of the inner edge 26 of the top piece 22 by an amount sufficient to provide a uniform band 54 extending inward from the line corresponding to the perimeter 18 of the crown 14, as illustrated in the perspective view of FIG. 13. Upon placement of the slip cover 20 over the brim 12 of a hat 10, the band 54 necessarily folds upward and wraps around the crown 14 and provides an additional ornamental member of the invention that can be used to further change the appearance of the hat. Note that at least the extension constituting the band 54 must be made of stretchable material such that the band may readily conform to the tubular shape of the crown 14 of the hat. The band 54 may be integral with the top piece 22 or attached to it as an extension of the inner edge 26. The height of the band 54 is chosen to conform to the style of the hat for which it is intended.

Figure 2:
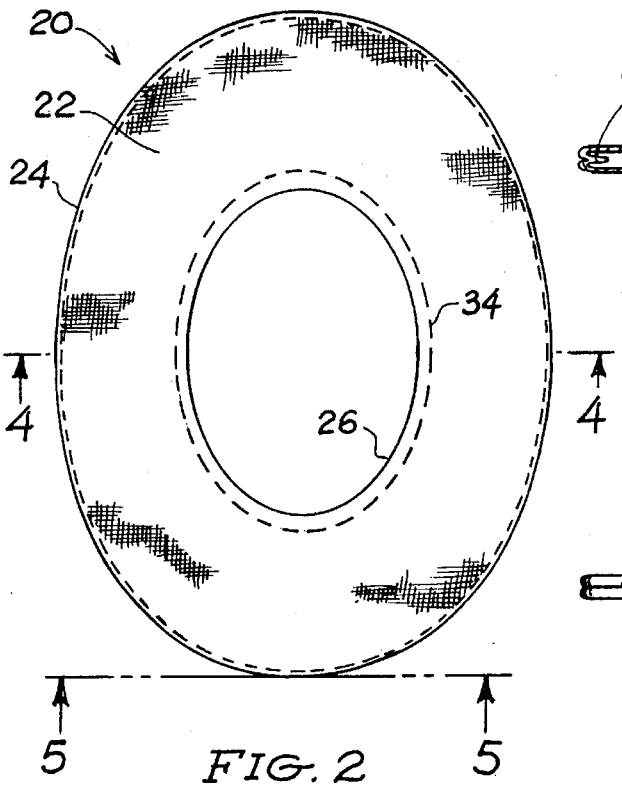
FIG. 2 is a top plan view of an embodiment of the slip cover according to the invention as seen while resting on a flat surface.

As in the case of the embodiment of FIG. 2, depending on the elasticity of the fabric used, it may be desirable to hem the inner edges 26 and 32 of the top and bottom pieces 22 and 28, respectively, and incorporate an elastic strip 46 to improve the appearance of the band 54 or to further increase the retaining function of the inner band 50. When the top piece 22 comprises a band 54, an elastic strip may also be added along the outer edge of the band 54 to improve the fit of the slip cover along the perimeter 18 of the hat crown 14 to ensure that the fabric remains taught and unwrinkled during use.

Various changes in the details, steps and materials that have been described may be made by those skilled in the art within the principles and scope of the invention herein illustrated and defined in the appended claims. For example, if the portion of the top piece of the slip cover matching the surface of the brim (that is, excluding the band 54) is made of non-streatchable material, it could be made wider than the brim of the hat, thereby enlarging the effective size of the brim while retaining all other features and benefits of the invention. Similarly, the band 50 extending inward from the perimeter 18 of ther crown 14 may be integral with the bottom piece 28 or consist of a separate band attached to the inner edge of the bottom piece 28.

Thus, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

I claim:

1. A slip cover for a hat having a substantially tubular crown with a predetermined inner perimeter and having a substantially-annular brim with a predetermined brim width and with outer and inner brim edges of predetermined sizes and shapes, comprising:

(a) a substantially-annular top member of flexible material having an outer edge approximately equal in size and shape to the brim outer edge and having a width approximately equal to the brim width, said top member having an open inner portion capable of receiving said substantially tubular crown;

(b) a substantially-circular bottom member of flexible and stretchable material having an outer edge approximately equal in size and shape to the brim outer edge and having a linear slit cut in said bottom member within a boundary corresponding to said inner perimeter of the crown, wherein said bottom member is entirely disposed on a plane parallel to said top member, thereby providing an inner stretchable opening within said inner perimeter of the crown; and (c) means for attaching said outer edges of the substantially-annular top member and the substantially-circular bottom member.

2. The slip cover recited in claim 1, wherein said top member further comprises a flexible and stretchable inner band extending inward from the inner edge of the top member.

3. The slip cover recited in claim 1, wherein said flexible and stretchable material consists of fabric.

4. The slip cover recited in claim 2, wherein said flexible and stretchable material consists of fabric.

5. The slip cover recited in claim 1, wherein said flexible and stretchable material consists of a polyurethane multifilament elastomer.

6. The slip cover recited in claim 2, wherein said flexible and stretchable material consists of a polyurethane multifilament elastomer.

7. The slip cover recited in claim 6, wherein said flexible and stretchable material consists of a polyurethane multifilament elastomer.

8. A method of manufacturing a slip cover for a hat having a substantially tubular crown with a predetermined inner perimeter and having a substantially-annular brim with a predetermined brim width and with outer and inner brim edges of predetermined sizes and shapes, comprising the following steps:

(a) cutting a substantially-annular top member of flexible material having an outer edge approximately equal in size and shape to the brim outer edge and having a width approximately equal to the brim width, thereby forming an open inner portion in said top member capable of receiving said substantially tubular crown;

(b) cutting a substantially-circular bottom member of flexible and stretchable material having an outer edge approximately equal in size and shape to the brim outer edge;

(c) cutting a linear slit in said bottom member within a boundary corresponding to said inner perimeter of the crown; and (d) attaching said outer edges of the substantially-annular top member and substantially-circular bottom member.

9. The method recited in claim 8, wherein said flexible material consists of a polyurethane multifilament elastomer.

10. A slip cover manufactured according to the process recited in claim 8.

11. A slip cover manufactured according to the process recited in claim 9.

* * * * *